United States Patent [19]

Minuto

[11] Patent Number: 4,919,392

[45] Date of Patent: Apr. 24, 1990

[54] VEHICLE JACK

[76] Inventor: Paul G. Minuto, 66 Mount Pleasant, P.O. Box 1004, Hudson, Quebec, J0P 1H0, Canada

[21] Appl. No.: 279,520

[22] Filed: Dec. 5, 1988

[51] Int. Cl.[5] ..... B66F 3/12

[52] U.S. Cl. ..... 254/126; 254/DIG. 2

[58] Field of Search ..... 254/122, 126, 124, DIG. 2, 254/419, 424, 425, 103

[56] References Cited

U.S. PATENT DOCUMENTS

| | | | |
|---|---|---|---|
| Re. 30,640 | 6/1981 | Keiholz . | |
| 3,645,501 | 2/1972 | Musgrove . | |
| 3,997,143 | 12/1976 | Rose | 254/122 |
| 4,093,182 | 6/1978 | Rutenbeck . | |
| 4,194,725 | 3/1980 | Erschens . | |
| 4,289,300 | 9/1981 | Weisser et al. | 254/126 |
| 4,366,948 | 1/1983 | Hafner . | |
| 4,557,355 | 12/1985 | Wilke et al. | 254/DIG. 2 |
| 4,653,727 | 3/1987 | Chang et al. | 254/126 |

*Primary Examiner*—Robert C. Watson
*Attorney, Agent, or Firm*—Arnold, White & Durkee

[57] ABSTRACT

Disclosed is a vehicle jack comprising a stand having an upper and a lower end and a lift arm having one end pivotably connected to the stand intermediate the upper and lower ends, the lift arm is moveable between a first position and a second position, and has a free end with a vehicle contact plate connected thereto. A lift arm drive assembly is connected between the stand and the lift arm and includes first and second housings and an elongate screw operative therebetween. The first housing is elongate and has an end pivotally connected to the lift arm between its ends and includes thread for operative cooperation with the screw. The second housing is pivotally connected to the upper end of the stand, the elongate screw having an axis and having one end rotatably but non-translationally connected to the second housing for rotation about the axis. The other end of the screw is threadably connected to the first housing. Drive means is connectible to the screw one end for selectively causing rotation of the screw in either direction, whereby selective rotation of the screw causes telescopic movement between the screw and the first housing and controls movement of the lift arm between the two positions.

8 Claims, 6 Drawing Sheets

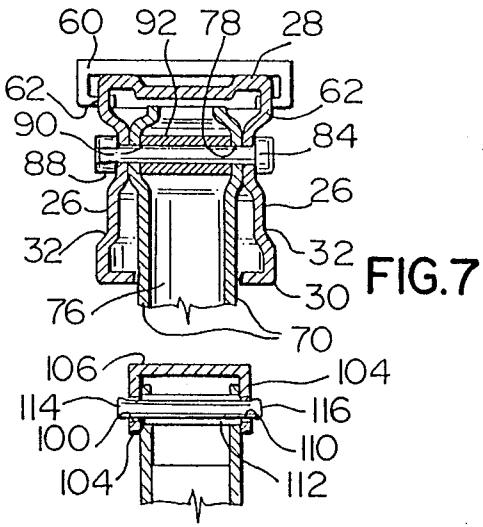
FIG.7
FIG.8
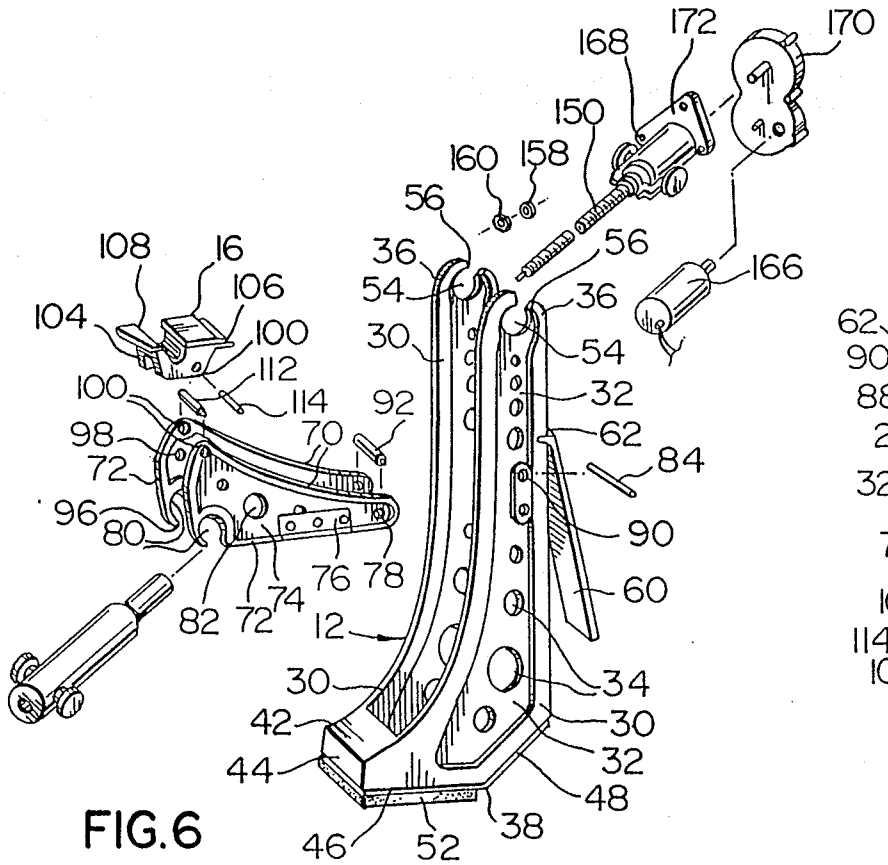
FIG.6

VEHICLE JACK

FIELD OF THE INVENTION

The invention relates to a jack and more particularly to a vehicle jack operable in cooperation with an appropriate manufacturer's jacking touch point on the vehicle to lift it from the side in order that a flat tire may be changed, wheels rotated, or the like.

BACKGROUND OF THE INVENTION

Jacks are basically portable tools for lifting heavy loads through relatively short distances and there are various kinds of jacks commonly in operation including screw jacks, rack and lever jacks and hydraulic jacks.

A large portion of the population is familiar with jacks in view of their historical association with vehicles such as the automobile. Jacks for automobiles have taken many forms and at one time "bumper" jacks were the most common, i.e. those jacks which lift one corner of a vehicle through operative association with a bumper. However bumpers on most vehicles are no longer being used as attaching points for jacks and there is a distinct move to jack vehicles through a cooperative association of a jack with touch or jack points provided by the manufacturer and usually accessed from the side of the vehicle.

Conventional touch point jacks used by garage service lifts must be positioned underneath the vehicle making it both awkward to operate and this obliges the operator to come into direct contact with the terrain the vehicle happens to be positioned on.

Further, there is a tendency for existing jacks to require enlarged base plates since the jacking process usually causes the jack to move off the vertical. If the jack leans too much, the situation becomes dangerous to the operator of the jack.

Accordingly, there is a need for a jack which is easily placed into location and contact with the appropriate touch point and which moves itself automatically into an alignment wherein the weight of the car being lifted is through the touch point contact or bracket or the jack and the base support.

Further, a jack which lifts the vehicle from the side rather than from underneath enhances the ease of locating the jack and the safe operation by the operator.

Vehicle jacks of the cantilever type are known and exemplified in U.S. Pat. Nos. 4,194,725, Mar. 25, 1980 to ERSCHENS; 4,289,300, Sept. 15, 1981 to WEISSER ET AL and Re. 30,640, June 9, 1981 to KEILHOLZ.

However, these jacks are not suitable for selective operation with electric motors of a type which maintain the general compactness of the device including eliminating translational movement between exposed elements which could be detrimental from a safety point of view.

SUMMARY OF THE INVENTION

Accordingly the present invention seeks to provide a jack which is extremely safe in that the operator, during the total jacking process, can have little or no physical contact with either the car or the jack, thus eliminating any possibility of an accident causing bodily harm. Before operating the jack, the operator simply positions it directly in line with the manufacturer's jacking touch point, steps back and engages the operating mechanism, which in the preferred embodiment, includes electric drive means.

The present invention also seeks to provide such a jack which uniquely lifts the vehicle from the side of the car, not from underneath. This allows the operator comfortable and easy access in order to position and operate the jack.

The invention pertains to a vehicle jack comprising a stand having an upper and a lower end and a lift arm having one end pivotably connected to the stand intermediate the upper and lower ends, the lift arm is moveable between a first position and a second position and has a free end with a vehicle contact plate connected thereto. A lift arm drive assembly is connected between the stand and the lift arm and includes first and second housings and an elongate screw operative therebetween. The first housing is elongate and has an end pivotally connected to the lift arm between its ends and includes thread for operative cooperation with the screw. The second housing is pivotally connected to the upper end of the stand, the elongate screw having an axis and having one end rotatably but not-translationally connected to the second housing for rotation about the axis. The other end of the screw is threadably connected to the first housing. Drive means is connectible to the screw one end for selectively causing rotation of the screw in either direction, whereby selective rotation of the screw causes telescopic movement between the screw and the first housing and controls movement of the lift arm between the two positions.

The invention also comprehends a vehicle jack of the cantilever type including a stand and lift means pivotally connected thereto. Means are provided for selectively causing pivoting movement between the lift arm and the stand including screw means and housing means, the screw means having an end pivotally connected to the stand and rotatable about the axis without translational movement relative to the stand. The housing is pivotably connected to the lift arm and threadedly connected to the screw means, whereby relative rotational movement between the housing and the screw means causes telescopic movement therebetween and pivotal movement of the lift arm relative the stand. Preferably selectively operable motor rotates the screw and the motor means is associated with and pivotal with the end of the screw means pivotally connected to the stand.

Other aspects and advantages will become apparent from the following specification taken in connection with the accompanying drawings.

BRIEF DESCRIPTION OF THE DRAWINGS

FIG. 6 is a rear view of the stand alone.

FIG. 7 is a sectional view of the pivot connection between the lift arm and stand taken along line 7—7 of FIG. 1.

FIG. 8 is a sectional view of the pivot connection between the lift arm and touch point bracket taken along line 8—8 of FIG. 1.

DESCRIPTION OF THE PREFERRED EMBODIMENT

Figure 1:
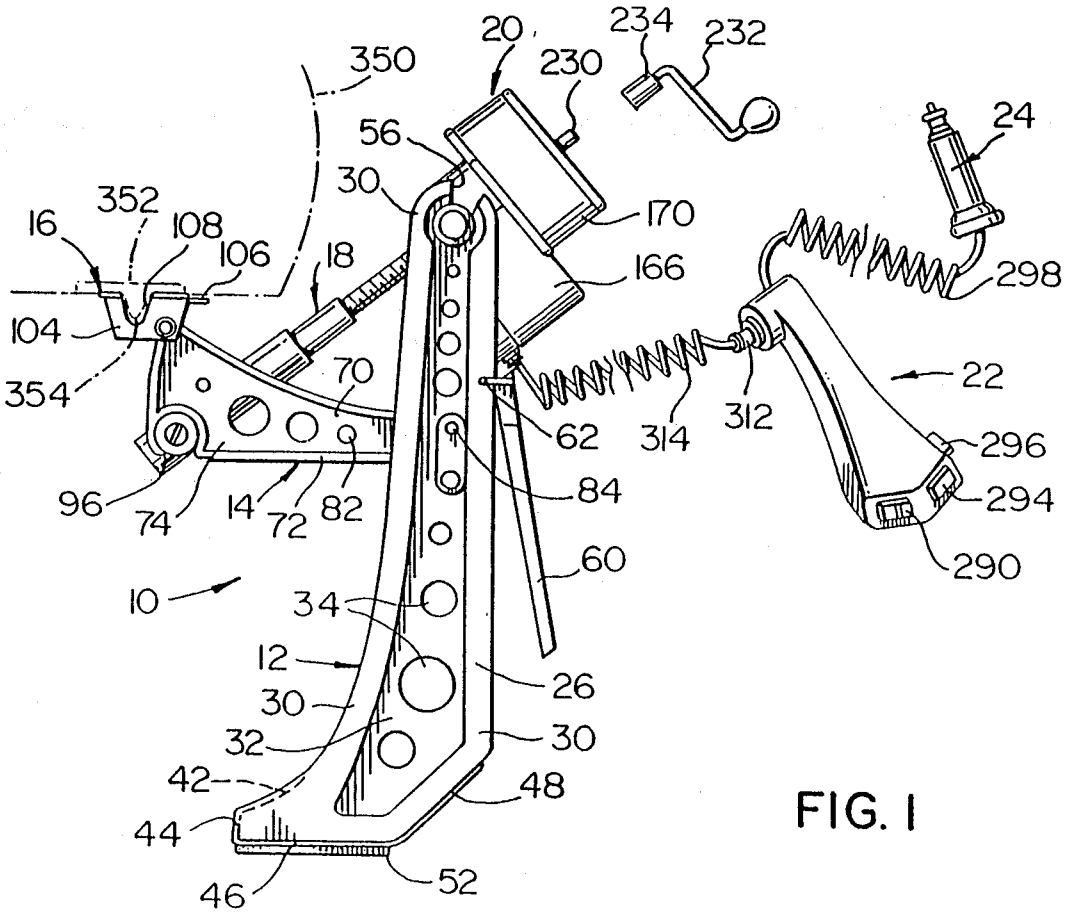
FIG. 1 is a side elevational view showing the jack in a fully elevated position along with the electric mode control assembly means and an emergency manually operating handle.

Turning to the drawings, jack 10 generally comprises base stand 12, lift arm 14, touch point bracket 16, screw drive assembly 18, drive means 20, control assembly 22 and electrical source plug 24.

More particularly, as shown in FIGS. 1 to 5, base stand 12 in cross-section is "U" shaped comprising two laterally spaced, steel plate legs 28, each leg having a peripheral inwardly curved edge 30 with depressed center area 32 to provide additional strength, and having a plurality of apertures 34 of varying diameter to lessen the weight without detrimentally affecting strength. Each leg 26 has an upper end 36 and lower, ground engaging end 38. Legs 26 are spacedly secured together to form a strong sturdy stand by back member 28 integral with legs 26 and by various cross members welded or otherwise secured elsewhere to legs 26 including lower front area 42, toe area 44, bottom area 46 and heel area 48. Back member 28 extends upwardly for a substantial height of the legs 26 and has curved or circular slot 50 therein. Foot pad 52 of rubberized material or the like is secured by gluing or alternatively rivets (not shown) to bottom 46. Although not shown, a like pad can also be affixed to heel portion 48.

The angle of heel portion 48 to bottom 46 is about 44°. It will be seen particularly from FIG. 6 that upper end 36 of legs 26 have cross aligned circular apertures 54 with upwardly rearwardly opening slots 56. Reinforcing edge 30 extends around apertures 54 to the edges of slots 56.

Figure 2:
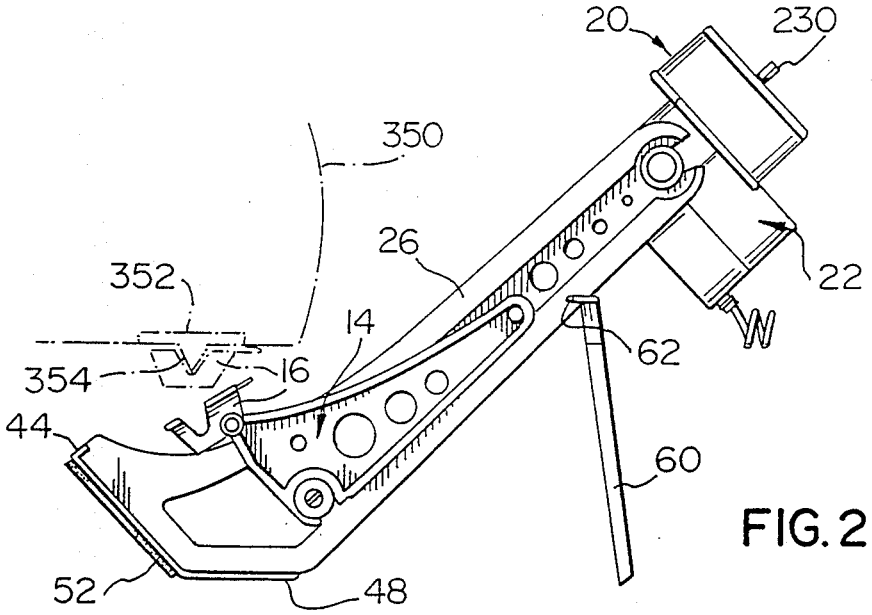
FIG. 2 is a side elevational view, with part of the near side of the stand cut away showing the jack in a fully lowered position but without the control assembly means or emergency operating handle.
Figure 3:
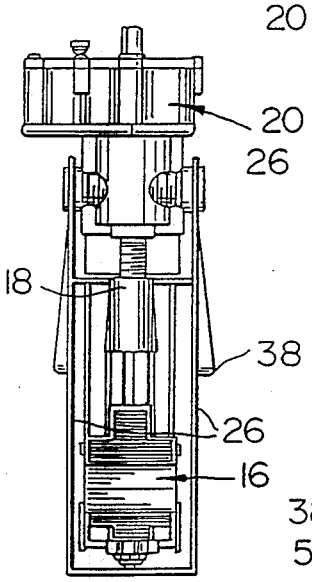
FIG. 3 is a view from above in the direction of arrow 3 of FIG. 2.
Figure 4:
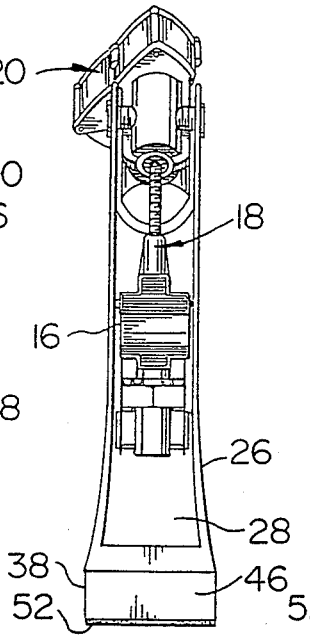
FIG. 4 is a view from above in the direction of arrow 4 of FIG. 1.
Figure 5:
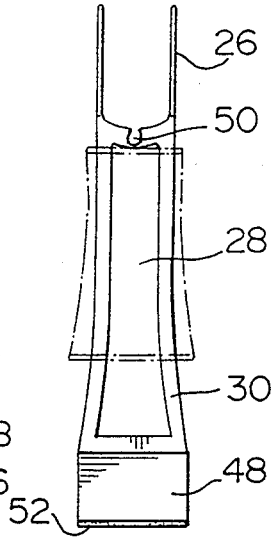
FIG. 5 is an exploded side elevational view in perspective of parts of the jack.

Support bracket 60 is pivotally connected at 62 to the rear edge of legs 26 and extends downwardly to support jack 10 when it is in a position as shown in FIG. 2.

Lift arm 14, somewhat foot shaped in side view and "U" shaped in end view comprises two laterally spaced steel plates 70, each with peripheral edges 72 and central, reinforcing area 74 which area 74 is laterally outward of the plane of edges 72. Arm 14 futher includes bottom, bight portion 76 (see FIGS. 5, 6 and 7) integral with plates 70 which bottom portion 76 runs from adjacent apertures 78 forward to adjacent slotted apertures 80. Holes 82 in plate 70 and bight portion 76 reduce weight without significantly lessening the strength of the arm 14. Pivot shaft 84 (FIGS. 6 and 7) has ends which are swaged over at 88 or otherwise secured to apertures 90 in legs 26. Pivot shaft 84 pivotably supports lift arm 14 with cylindrical spacer 92 secured between the inner sides of plates 70 adjacent rear pivot apertures 78 and through which shaft 84 extends, the spacer 92 providing additional lateral strength to lift arm 14 adjacent the pivot connection. Apertures 78 and spacer 92 permit pivoting of arm 14 about pivot shaft 84. The "heel" portion of lift arm 14 has slotted apertures 80 with ingress or lead in slots 96 and has front cross plate 98 welded or otherwise secured to front edges 72 for reinforcing arm 14 above apertures 80. The toe area of arm 14 has cross aligned apertures 100.

Touch point bracket 16 is of generally inverted "U" configuration with side members 104 and upper bight or support element 106. Bracket 16 includes slot 108 ("U" shaped in side view) in members 104 and element 106 to facilitate cooperation between bracket 16 and any rib means or the like associated with a vehicle touch point. As more particularly shown in FIG. 8, touch plate 16 further includes side member apertures 110 and associated through bore reinforcing spacer 112 which is secured to the inside of lift arm members 70 by welding or the like. Pivot shaft 114 is swaged over or otherwise secured about apertures 100 of plates 70 and extends through apertures 110 and spacer 112 permitting pivoting of bracket 16 about shaft 114.

Figure 9:
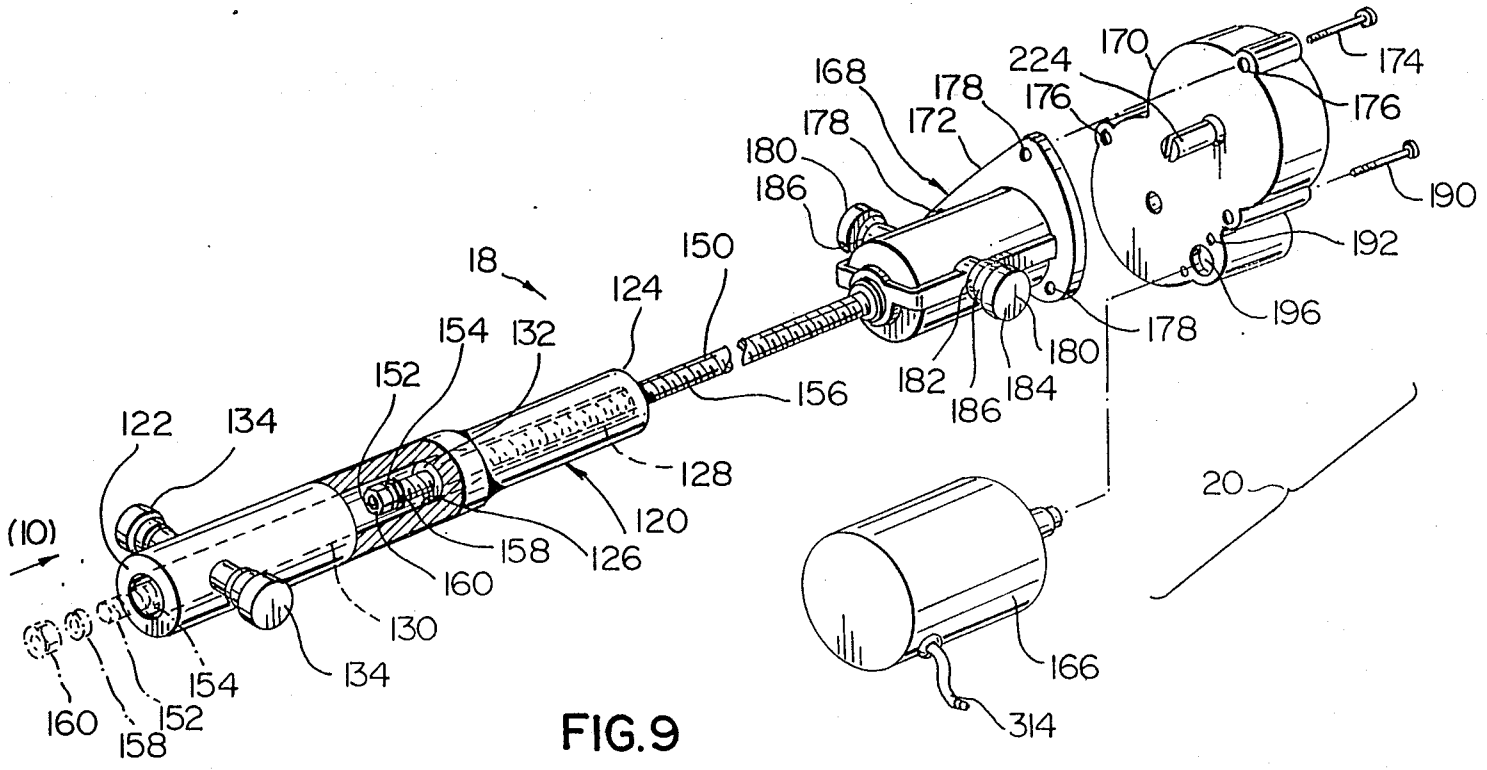
FIG. 9 is an exploded perspective view of the drive means including drive shaft, housing, motor and gear housing.
Figure 10:
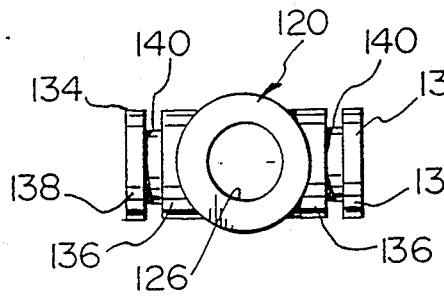
FIG. 10 is an end view of the drive shaft taken in the direction of arrow 10.
Figure 11:
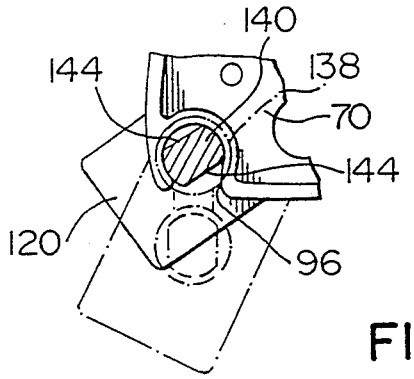
FIG. 11 is an enlarged side view, partly in section, of the connection between the lift arm and drive shaft housing.
Figure 12:
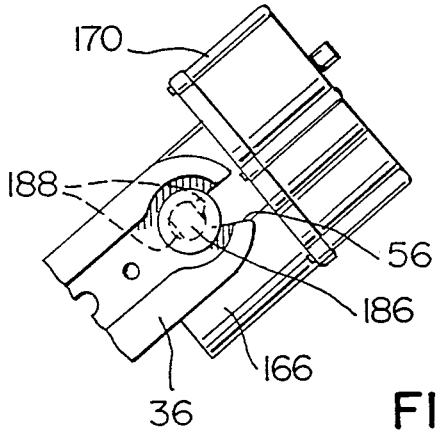
FIG. 12 is an enlarged side view, partly in section, of the connection between the lift arm and drive shaft housing.

As more particularly shown in FIG. 9, lift arm drive assembly 18 includes lift arm drive screw housing 120 having opposed ends 122 and 124 with internal, through bore 126 therebetween. Bore 126 has threaded portion 128 and non-threaded portion 130 with shoulder 132 intermediate portions 128 and 130. Housing 120 may be integrally molded of strong ABS plastic and has laterally extending opposed pivot members 134 adjacent end 122. FIG. 10 is an end view of housing 120 showing the pivot members 134 each including inner and outer circular flange members 136 and 138 with area pivot 140 of reduced diameter therebetween. As shown in FIG. 11, the periphery of pivot 140 is flattened at 144 so that the diametric extent of pivot 140, perpendicular to flat 144, is such that pivots 140 can be inserted (as shown in dotted lines) through respective slots 96 into apertures 80 of lift arm 14 to provide a sturdy pivotal connection. The location of slots 96 and flats 144 are such that once housing 120 is assembled with lift arm 14, alignment of flats 144 with respective slots 96 is not encountered during use of the jack. Circular flanges 136, 138 also tend to limit any lateral movement of plates 70 adjacent pivot members 134.

As shown in FIG. 9, drive screw 150 includes threaded end shank 152 and shoulder 154, the remaining portion 156 being appropriately threaded for cooperative association with threaded bore 128 of housing 120. In assembling drive screw 150 to housing 120, the drive screw is rotated until end 152 and shoulder 154 are exposed as shown in dotted lines so that washer 158 and lock nut 160 can be assembled with shank 152. The washer is of a size that it will move within non-threaded bore portion 130 as the screw 150 approaches the opposite end of its travel (e.g. FIG. 9), and when at the end of its travel, washer 158 engages shoulder 154 about threaded bore 128. It will be appreciated that preferably the threaded connection between shank 152 and nut 160 is opposite to that of screw portion 150.

As more particularly shown in FIGS. 9 and 12–15, drive means assembly 20 comprises motor 166, drive screw housing 168 and gear housing assembly 170. Gear housing 170 is secured to flange 172 of motor drive screw housing 168 by appropriate means such as bolts 174 (one shown) in conjunction with gear housing aperture 176 and threaded aperture 178 in flange 172. Drive screw housing 168 is of cast aluminum and has opposed pivot members 180 each having inner and outer circular flange members 182 and 184 with pivot portions 186 of reduced diameter therebetween. Pivot members 180 are constructed similar to those shown in FIG. 10 for housing 120 and pivots 180 have flat portions 188 (see FIG. 12) so that the diametric extent of pivot 180 perpendicular to flat 188 is such as to permit pivots 180 to pass through slots 56 on leg ends 36. Motor 166 is secured to gear housing assembly 170 by bolts 190 in association with housing apertures 192 and threaded apertures (not shown) in motor housing 166. Motor drive gear 194 fits within opening 196 in gear housing 170 for selected engagement with an appropriate gear in housing 170. When drive screw housing 168, gear housing 170 and motor 166 are secured together, motor 166 is directly below housing 168 and is adapted to swing between legs 26 above slot 50 in back 28 when jack 10 is in use.

Figure 13:
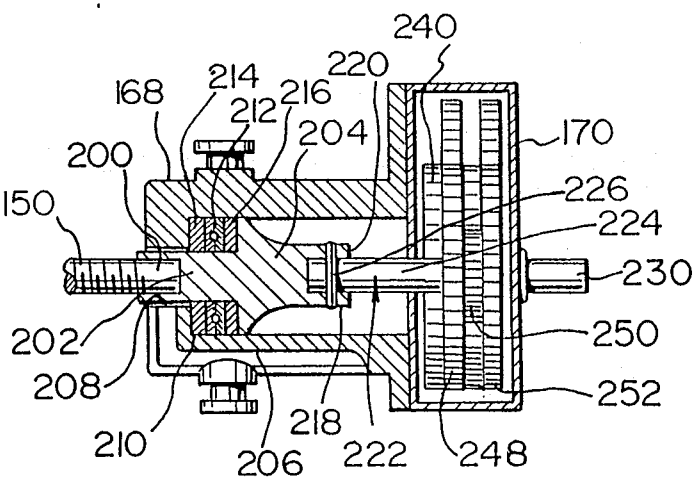
FIG. 13 is a partial sectional view of the gear housing and motor pivot support taken generally along line 13—13 of FIG. 2.

FIG. 13 is a partial cross-sectional view through housing 168 and gear housing 170 showing screw shaft 150 having end 200 welded or otherwise secured to shank 202 of coupling member 204 which has bearing plate flange member 206. Drive screw housing 168 has opening 208 through which shank 202 extends and between housing end 210 and bearing plate flange member 206 is thrust bearing 212 and hardened steel bearing plates 214 and 216. Coupling member 204 has annular end 218 having an opening 220 into which the slotted end 222 of shaft 224 from gear housing 170 is adapted to fit. Pin 226 associated with holes 228 in end 220 engages slotted end 222 of shaft 224. Shaft 224 extends through gear housing 170 and has manual drive coupling end 230. Handle 232 (FIG. 1) has coupling means 234 adapted for detachable connection with end 230 for manual rotation of shaft 224 and shaft 150.

Figure 14:
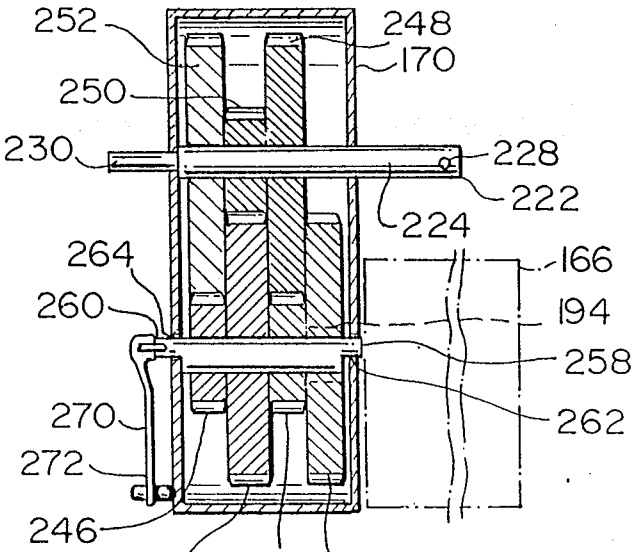
FIG. 14 is a sectional view of the gear housing taken along line 14—14 of FIG. 9.

FIG. 14 shows gear housing 170 with gears 240, 242, 244, 246, 248, 250 and 252 in sectional view. Gears 240 and 242 are secured together (shown as joined) and freely rotate as a unit on shaft 254. Motor drive gear 194 meshes with gear 240 of the unit. Gears 244 and 246 (shown joined) also freely rotate as a unit on shaft 254. Shaft 254 has eccentric ends 258 and 260 suitably journalled in housing apertures 262 and 264.

Figure 15:
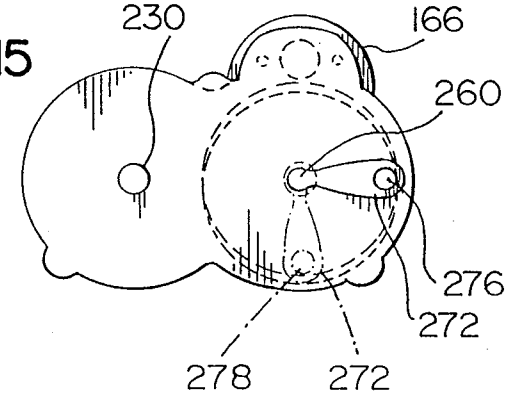
FIG. 15 is an end view of the gear housing.

Gears 248, 250 are secured together (shown joined) and freely rotate as a unit on shaft 224. Gear 252 is fixedly secured to shaft 224 by any appropriate means and causes rotation of shaft 224 when rotated. As shown in FIGS. 14 and 15, end 260 of shaft 254 has secured thereto lever means 270 which is rotatable from position A to B so that when shaft 254 is selectively rotated (90°), shaft 254 rotates about eccentrically journalled ends 258, 260 and carries gears 242, 244 and 246 in and out of engagement with gears 248, 250, 252.

Lever means 270 is of spring metal and its free end 272 is raised against the bias of the lever material so that hole 274 is located about protrusions 276 or 278 (FIGS. 14–15) to lock the shaft so that the gears thereon are in or out of mesh to engage or disengage motor 166 from the drive shaft 224. The longer dotted lines in FIG. 15 represent engagement of gears whereas the shorter dotted lines represent disengagement.

The assembly of gears provides for effective drive of shaft 224 by motor 166 but they also have a self locking or braking effect so when gears 242, 244 and 246 are engaged with gears 248, 250 and 252, shaft 224 cannot be rotated without operation by the motor 166 or manual means 232 associated with shaft end 230. Accordingly, if the motor 166 fails for any reason, the gears, when engaged, do not permit free rotation of shaft 224.

Motor 166 is a 12 volt, 1.3 horsepower motor absorbing from 2.5 amps when no load, to from 6 to 16 amps when loaded, depending on the weight of the vehicle to be lifted.

Figure 16:
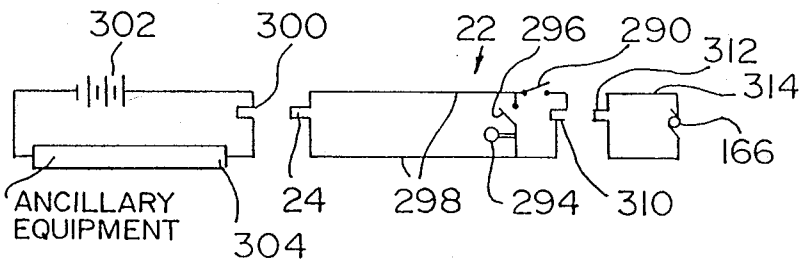
FIG. 16 is a schematic diagram of the electrical aspects of the invention.

As seen schematically in FIG. 16, motor 166 is powered through a biased open, two position, no release switch 290 housed in control assembly 22 which assembly 22 includes service lamp 294 having separate on-off switch 296. Control assembly 22 is permanently electrically connected to source plug 24 through wires 298 which plug 24 is adapted to connect to the vehicle lighter in known fashion, which lighter is in electrical association with battery 302 and other equipment 304. Control assembly 22 has a female connection 310 for detachable cooperation with male terminal 312 of electrical wires 314 which are electrically connected to motor 166.

With detachable connections 310, 312, it will be apparent that control assembly 22 can be used separately as a safety or service light, motor 166 of jack 10 being selectively connectable into the power circuit through the connections 310, 312.

In operation, looking at FIG. 2, jack 10 manoeuvered adjacent the side of a car, part of which is shown in dotted lines 350 which vehicle has a touch point plate 352 and locate projections or ribs 354. Assuming the plug 24 is then or has already been connected to a lighter socket 300 of the vehicle, the switch 290 is activated so that motor 166, through drive assembly 18, rotates screw 150 relative to housing 120 causing the drive assembly to foreshorten, i.e. screw 150 rotatably telescopes within housing 120 causing lift arm 14 to pivot relative stand 12. Thus touch point bracket 16 is raised whereby lip 106 contacts the touch plate ad this causes bracket 16 to pivot so that notch or slot 108 can be located in association with rib 354 of touch plate 352. Continued actuation of switch 290 causes the drive assembly 18 to foreshorten raising the lift arm 14 further and in so doing, stand 12 is gradually pulled upwardly, from resting on head portion 48 to bottom 46 (and foot pad 52) to assume the position shown in FIG. 1. It will be apparent that the construction of screw housing 168 in association with motor 166 allows housing 168 and motor 116 to swing within the gap between the upper ends of stand legs 26.

Reversing the switch 290 reverses the motor and causes relative lengthening of the drive assembly and the lowering of lift arm 14 to finally assume the position shown in FIG. 2, the stand 12 reversing its rotation from bottom 46 to heel portion 48.

In the event that the motor will not work, gear housing lever 270 can be rotated so that the gears associated with the motor drive can be pivoted out of engagement and handle or crank 232 used to manually rotate screw 150 in either direction.

Although not shown, there is preferably a device associated with control assembly 22 which automatically stops motor 166 at the end of the stroke of drive shaft 150, even if switch 290 continues to be activated.

Such device would also cycle operation in case of repeated operations at short intervals.

While there have been shown and described and pointed out the fundamental novel features of the invention as applied to the preferred embodiment, it will be understand that various omissions and substitutions and changes of the form and details of the device illustrated and in its operation may be made by those skilled in the art, without departing from the spirit of the invention.

I claim:

1. A cantilever vehicle jack comprising:

stand means having an upper end and a lower end, the upper end having laterally spaced legs and open back;

lift arm means having one end pivotably connected to said stand means intermediate the upper and lower ends and moveable between a first position and a second position, said lift arm means having a free end and a vehicle contact plate connected thereto;

lift drive means connected between said stand means and said lift arm means and including first and second housings and an elongate screw operative therebetween, said first housing being elongate and having an end pivotally connected to said lift arm means below the contact plate and between its ends and including thread means for operative cooperation with said screw, said second housing being pivotally connected to the spaced side legs of the upper end of said stand and adapted for pivoting between said legs, said elongate screw having an axis and having one end rotatably but non-translationally connected to said second housing for rotation about the axis, the other end of said screw threadably connected to said first housing;

motor means supported by said second housing and adapted for swinging movement within said spaced legs and back of the upper end, said motor means connectible to said screw one end through gear means in a gear housing also supported by said second housing for swinging movement for selectively causing rotation of said screw in either direction;

whereby selective actuation of said motor means causes rotation of said screw through said gear means and telescopic movement between said screw and said first housing controlling movement of said lift arm between said two positions.

2. The jack according to claim 1 wherein said first housing includes a through bore including a threaded section and a non-threaded section, said non-threaded section being adjacent said pivotal connection of said first housing with said lift arm means, said screw having its end associated with said housing capable of accepting a lock nut and washer which is acceptable within said non-threaded section and in association with a shoulder defined between the threaded and non-threaded section limits extension of said screw relative said threaded portion.

3. The jack according to claim 2, wherein said second housing is hollow with an end having a bore therethrough and a shoulder defined thereabout, said one end of said screw rotatably connected with coupling means rotatably supported within said pivotal second housing, said coupling means being connectible to said gear means.

4. The jack according to claim 3, wherein said gear means includes a gear set drivingly associated with said motor and a gear set drivingly associated with said coupling means, and means for selectively disconnecting said motor associated gear set from said coupling associated gear set.

5. The jack according to claim 6, further including means for selectively manually rotating said coupling means when said motor set is disconnected.

6. The jack of claim 5, wherein said second housing includes pivots integral therewith and each pivot having integral inner and outer flanges, said second housing pivots and upper end legs adjacent the area of pivotable connection therebetween being constructed such as to allow said pivots to be connected to said stand legs with said inner and outer integral flanges restricting inner and outer lateral movement of said stand legs.

7. The jack of claim 6, including switch control means for selective operation of said motor, said switch control means including a power source plug adapted for connection with a power source socket.

8. The jack of claim 7, wherein said switch control means includes selectively operable light means.

* * * * *